United States Patent [19]

Swanson

[11] 4,064,991

[45] Dec. 27, 1977

[54] PAINT BRUSH MERCHANDISING DISPLAY

[75] Inventor: Harold Swanson, New York, N.Y.

[73] Assignee: Baker Brush Co., Inc., Springdale, Conn.

[21] Appl. No.: 772,869

[22] Filed: Feb. 28, 1977

[51] Int. Cl.[2] ..... A47F 7/00

[52] U.S. Cl. ..... 211/49 R; 211/60 T; 211/65; 248/220.4

[58] Field of Search ..... 211/65, 66, 184, 50, 211/94.5, 94, 49 R, 60 T, 60 R; 248/220.3, 220.4, 110

[56] References Cited

U.S. PATENT DOCUMENTS

| | | | |
|---|---|---|---|
| 2,130,197 | 9/1938 | Schick | 211/49 R |
| 2,879,899 | 3/1959 | Shenkin | 248/220.4 X |
| 2,996,192 | 8/1961 | Dell et al. | 211/49 R |
| 3,002,632 | 10/1961 | George | 211/184 |
| 4,018,341 | 4/1977 | Jarecki | 248/220.4 X |

*Primary Examiner*—Roy D. Frazier
*Assistant Examiner*—Robert W. Gibson, Jr.
*Attorney, Agent, or Firm*—Mark T. Basseches; Paula T. Basseches

[57] ABSTRACT

The present invention is directed to a merchandising display device for paint brushes, and more particularly to a device for use in retail establishments, the device being characterized by the brush holding components providing a substantial degree of adjustability whereby stock display parts may be readily shifted to accommodate brushes of a variety of sizes.

5 Claims, 3 Drawing Figures

PAINT BRUSH MERCHANDISING DISPLAY

BACKGROUND OF THE INVENTION

1. Field of the Invention

The present invention is in the field of display devices, and more particularly a display device for merchandising paint brushes.

2. The Prior Art

In the merchandising of paint brushes, it is conventional to supply a display means, such as a pegboard or the like having a plurality of hooks. The brushes may be provided with through-going holes in the handles which are used to support the brushes on the hooks. Frequently brush displays of the noted type are directly accessible to shoppers who, in selecting a brush, may remove one or more brushes from their hooks in order to determine which brush is appropriate for their particular needs. Often the consumers will replace brushes on the wrong hooks, to the resultant confusion of subsequent shoppers.

A further difficulty with existing brush displays of the type described lies in the fact that when a different brush size or style is added to the line, it is frequently necessary to reorient the multiplicity of hooks in order that the brushes will hang in such manner as not to interfere with one another.

SUMMARY OF THE INVENTION

The present invention may be summarized as directed to an improved display and merchandising apparatus for paint brushes characterized by efficient use of valuable display space, complete visibility of the brush components, and great flexibility, permitting facile rearrangement for accommodation of different styles and sizes of brushes, the device having the inherent capability of ensuring that brushes of a given size may be mounted only in the display area intended to be occupied by brushes of that size.

In accordance with the invention there is provided a display board or panel, such as a pegboard, having one or more support trays, each including an upwardly directed planar paint brush support mounting surface or ledge. A plurality of brush support members are adapted to be mounted on the ledges, the support members including frictional clamp means selectively positionable lengthwise along the ledge. The support members include vertically directed divider portions, the lower edge of which includes a transversely extending web projecting a slight amount to both sides of the divider. The webs of adjacent support members define therebetween slots having perimetal tracks.

Brushes are mounted by hanging the same between tracks, the tracks underlying the junction between the handle and the head, whereby a properly sized brush will be supported between adjacent support members, with the handle projecting downwardly through the slot between the tracks.

A plurality of support members may be mounted on a single shelf, in which case each but the endmost of the support members functions to support a row of brushes to either side of the divider.

A brush can be replaced only in the proper storage space for its size since if the head of the brush is too large it will not fit between the adjacent support members, and if it is too small for a given space, the tracks will not underlie the head.

Accordingly, it is an object of the invention to provide a brush merchandising display apparatus of novel and attractive design characterized by the ability of the display, through the use of stock parts, to be adjusted to accommodate brushes of any selected size, the same parts being useful, in accordance with their adjusted position along the shelf, to accommodate or be adjusted to accommodate brushes of any given size.

A further object of the invention is the provision of a device of the type described wherein brushes removed from the device can be replaced only within an appropriately sized compartment and thus cannot, through inadvertence, be mixed in with brushes of a different size.

A still further object of the invention is the provision of a device of the type described which is inexpensive to manufacture, which uses stock parts for all sizes of brushes, and which makes efficient use of available display space.

To attain these objects and such further objects as may appear herein or be hereinafter pointed out, reference is made to the accompanying drawings, forming a part hereof, in which.

Figure 1:
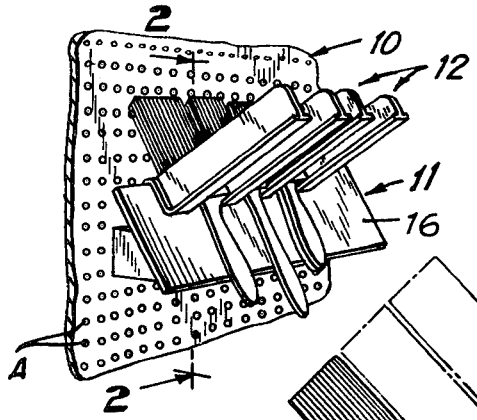
FIG. 1 is a fragmentary perspective view of a display device in accordance with the invention.

Turning now to the drawings, there is shown in FIG. 1 a section or area of a paint brush merchandising device in accordance with the invention. The devices include a pegboard or like panel support 10 which may, as desired, be permanently fixed to a wall of a merchandising establishment or to a support framework having a base or stand adapted to be mounted on a floor or counter. Although the device is illustrated as including a single support tray assembly 11 carrying a multiplicity of brush support members 12, it will be readily recognized that a plurality of shelf units 11 may be mounted on the panel 10 and that the number of brush support units secured to the shelf is not limited to the four illustrated in FIG. 1.

Figure 2:
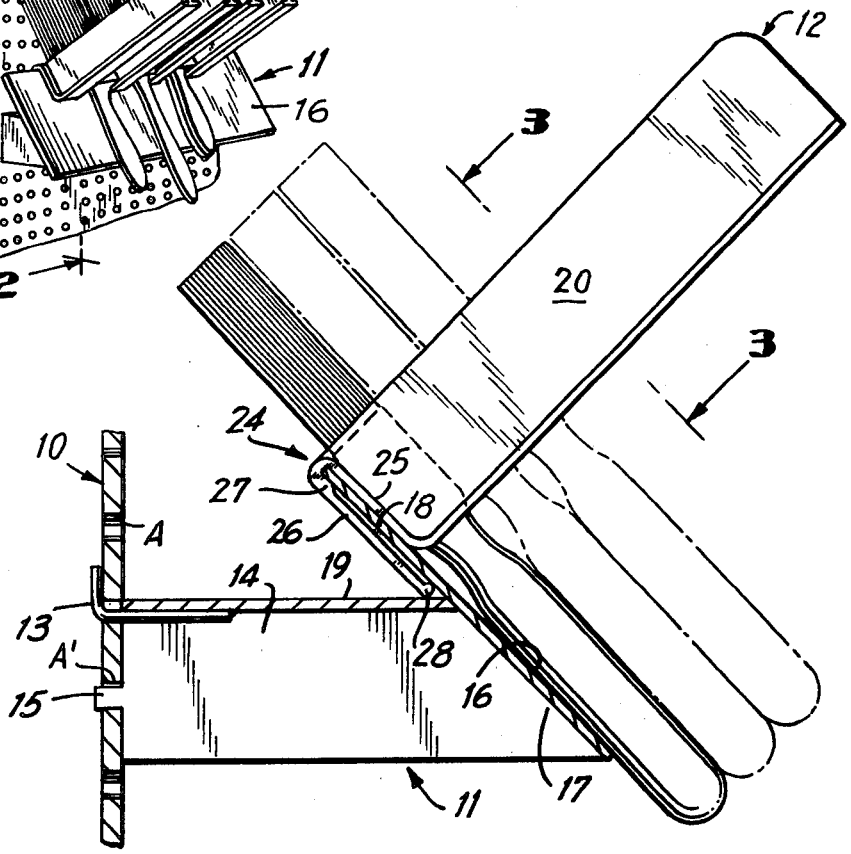
FIG. 2 is a magnified vertical sectional view taken on the line 2—2 of FIG. 1.

The shelf support unit 11, as best seen in FIG. 2, includes means for mounting the same to the panel 10. Such means may include the conventional hanger hooks 13 affixed to support struts 14, each shelf unit including at least two such struts 14. Optionally but preferably, the struts may carry stabilizer buttons 15 spaced from the hanger hooks 13 a distance to correspond to the spacing between article support apertures A formed in the pegboard. Thus, when hook 13 is secured in one such aperture A, stabilizer button 15 will register and seat within a corresponding aperture A'. Alternate means for mounting the shelf to the panel 10 may be employed, and such mounting means forms no part of the present invention.

The struts 14 carry an elongate mounting plate 16, the plate 16 being preferably formed of rigid metallic material welded or otherwise affixed to the outer ends 17 of the struts 14. The mounting plate 16 includes an upwardly extending ledge portion 18, the ledge portion being that part of the plate which projects above the upper surface 19 of the strut 14.

As best seen in FIGS. 1 and 2, the plate 16 is inclined downwardly and outwardly with respect to the panel 10. The plate 16 and, more particularly, the upwardly directed ledge portion thereof, forms an uninterrupted, transversely extending flange or support along the length of which may be positioned the brush support members 12 next to be described.

Figure 3:
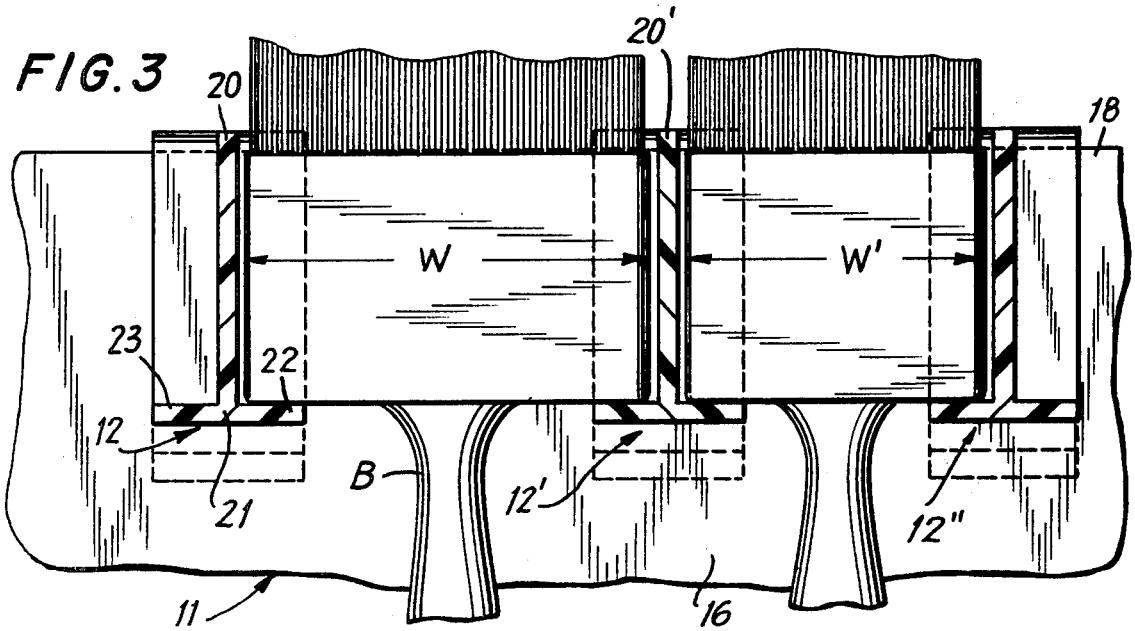
FIG. 3 is a sectional view taken on the line 3—3 of FIG. 2.

The support members 12, which are preferably formed of transparent polymeric material of substantial rigidity and resilience, are generally T-shaped in cross section (see FIG. 3) along the majority of their length and comprise a vertically extending divider portion 20, to the lower edge of which is affixed horizontally directed web 21. The web 21 extends a short distance to both sides of the divider 20, whereby there are defined laterally directed track portions 22, 23.

The support members 12 include clamp assemblies 24 adapted frictionally to engage the ledge 18 of plate 16. Clamp assembly 24 includes a pair of spaced arms 25, 26, which arms together define an essentially inverted U-shaped configuration.

Arm 26 preferably includes spaced enlargements 27, 28 adjacent the upper and lower margins thereof. In the unstressed (prior to mounting) position of the spring clamp 24, the arms 25, 26 converge slightly. When the clamp assembly 24 is mounted over the ledge 18, the arms 25, 26 must be spread from their converging position, whereupon, when the clamp is sleeved over the ledge 18, the material, by virtue of its resilience, will capture the ledge in a frictional grip between the arms 25, 26. The provision of enlargements 27, 28 assures a continuous and effective gripping of the ledge 18 between the noted parts.

In use, the retailer will mount one or more of the shelves 11 on the pegboard 10 in the manner described. Thereafter, a plurality of the brush supports, e.g. 12, 12', will be mounted over the ledge portion 18 in spaced relation, the spacing between the dividers 20, 20' (see FIG. 3) being calculated to correspond, with minor clearances, to the width W of the brush B intended to be held between the supports 12, 12'.

After positioning of the supports 12, 12', a further support 12'' may be mounted over the ledge 18, the spacing between the supports 12' and 12'' being again calculated in accordance with the width W' of the brush intended to be supported by the members 12', 12''.

It will be noted that the flanges or tracks 22, 23 of adjacent brush supports underlie the junction between the head and the handle of the brush and prevent the head of a properly sized brush from falling through the slot between adjacent tracks.

It will be further appreciated that a central support member, such as the support member 12' which is disposed between two other support members 12 and 12'', coacts with each of the two outside support members, whereby the longitudinal space along the shelf member 11 is efficiently employed.

If an attempt should be made to replace a brush within a compartment (between two dividers) not corresponding to the width of the brush, the brush will simply fall through the slot between adjacent tracks if it is too small, or not fit between the adjacent dividers if it is too large. Preferably, the flanges or tracks 22, 23 extend only a small distance beyond the dividers (e.g. less than one half inch) so that an undersize brush cannot inadvertently be retained.

Should it be desired to modify the display to accommodate larger or smaller brushes, it is necessary merely to adjust the position of the support members longitudinally of the shelf 11 to correspond to the width desired.

It will be noted that the track portions 22, 23, by virtue of their attachment to the inclined shelf plate 16, are themselves inclined downwardly and toward the main support panel 10. By reason of this arrangement, the brushes stacked between adjacent support members will be gravitationally maintained against the plate in orderly array at an angle corresponding to the angle to inclination of the plate. If desired, means may be provided for varying the angularity between the plate 16 and the panel 10.

From the foregoing it will be appreciated that there is provided in accordance with the invention an attractive, inexpensive and flexible brush display device wherein the maintenance of an orderly array of brushes is assured and wherein misplacement of a brush is precluded.

While the device is capable of accommodating brushes of a wide variety of widths, the same parts are used regardless of brush size, size variations being accommodated by modifying the lateral spacing of the support members 12 along the ledge 18.

Having thus described the invention and illustrated its use, what is claimed as new and is desired to be secured by Letters Patent is:

1. A paint brush merchandising display apparatus adaptable to support brushes of a variety of widths comprising, in combination, a generally vertically arrayed display panel, a support tray assembly including attachment means for securing said tray assembly to said panel, said assembly including a horizontally extending planar mounting plate member, said mounting plate member being angularly oriented relative to said panel and including an upper free marginal portion defining an uninterrupted support ledge, and a plurality of brush support members mounted on said ledge and adjustably positionable therealong, said support members including clamp members in the form of inverted U configurations disposed over and frictionally engaging said ledge, a vertically directed divider portion extending from said clamp portion and a transversely directed support web extending from said clamp portion, said web being fixed to the under surface of said divider portion and extending laterally a distance to both sides of said divider, said web terminating in free edges paralleling said divider portion, said divider portion and said web being inclined away from said panel the opposed webs of adjacent said support members defining spaced parallel tracks whereby a plurality of inverted paint brushes may be mounted between adjacent said support members with the head portions of said brushes seated on said tracks and the handle portions of said brushes extending downwardly through the spaces between said tracks.

2. A display apparatus in accordance with claim 1 wherein said brush support members comprise integrally molded resilient transparent polymeric material and the branches of said U-shaped clamp members are normally spaced apart a distance less than the thickness of said ledge whereby, when said clamp members are mounted over said ledge, said brush support members are frictionally retained at an adjusted position along said support tray assembly.

3. A display apparatus in accordance with claim 2 wherein one said branch of said clamp member, in the mounted position of said brush support members on said ledge, is yieldably urged against a face of said ledge, said one branch including a first enlargement engaging said ledge adjacent an upper margin thereof and a second enlargement engaging said ledge in spaced relation to said first enlargement.

4. Apparatus in accordance with claim 1 wherein at least three said support members are mounted on said support tray assembly to define at least two sets of spaced parallel tracks, and a row of brushes is mounted between each said pair of spaced parallel tracks, whereby the central said support member of said three provides support for each of said at least two rows of brushes.

5. Apparatus in accordance with claim 1 wherein said webs are inclined toward said panel, whereby brushes supported between adjacent said tracks are gravitationally maintained in contact with said panel.

* * * * *